United States Patent [19]

Hui

[11] 4,161,843

[45] Jul. 24, 1979

[54] ELECTRICALLY POWERED TOY AIRCRAFT

[76] Inventor: Danny C. T. Hui, 15 Trudy Rd., Willowdale, Ontario, Canada, M2J 2Y7

[21] Appl. No.: 938,840

[22] Filed: Sep. 1, 1978

[51] Int. Cl.[2] ..... A63H 27/04

[52] U.S. Cl. ..... 46/75; 272/31 B; 46/77; 244/17.23

[58] Field of Search ..... 46/75, 77; 272/31 B; 244/17.23, 26

[56] References Cited

U.S. PATENT DOCUMENTS

| | | | |
|---|---|---|---|
| 990,897 | 5/1911 | Newbury | 244/26 |
| 3,119,611 | 1/1964 | Bennett | 272/31 B |
| 3,579,905 | 10/1967 | Radford | 46/77 |
| 3,731,424 | 5/1973 | Meyer | 46/77 |
| 3,919,805 | 11/1975 | Stanzel | 46/77 |
| 3,982,977 | 3/1976 | Arlin | 46/75 |

*Primary Examiner*—Louis G. Mancene
*Assistant Examiner*—Robert F. Cutting

[57] ABSTRACT

The specification describes a toy including a flying body and a flexible cable interconnecting the flying body and means for operating the flying body. The flying body is provided with four identical propellers rotatable in the horizontal plane and arranged in a rectangular pattern. A drive motor is located centrally of the four propellers and drives gear means for rotating the four propellers at the same speed. A fifth smaller propeller is also provided, which is rotatable by the motor in the vertical plane. Each of the propellers is provided with a protective frame.

10 Claims, 6 Drawing Figures

ELECTRICALLY POWERED TOY AIRCRAFT

FIELD OF THE INVENTION

This invention relates to an electrically powered toy aircraft.

BACKGROUND OF THE INVENTION

There are presently available many different types of electrically powered toy aircrafts, such as propeller driven airplanes and helicopters. Some of the various arrangements include the provision of an airplane on the end of a pair of controlling hand-held lines, which are manually controlled by the operator as shown in U.S. Pat. No. 3,579,905 issued May 25, 1971 to J. T. Fadford and R. A. Mizrany. This type of an arrangement requires a high level of skill on the part of the operator, because the airplane must be operated at high speeds in order to maintain tension on the lines which control the height at which the airplane flies. Anyone who has flown such a toy will appreciate that any sudden exaggerated movement of the handle will result in an uncontrollable dive by the airplane.

Other arrangements have been suggested wherein an aircraft, such as a helicopter is provided at the end of a non-flexible rod secured to a rotating stand. However, with these arrangements, real flight conditions cannot be simulated due to the rigidity of the supporting rod, which does not permit unrestrained flight patterns, and quickly looses the interest of the operator.

A further arrangement has been used wherein an airplane is secured to a rotatable stand by means of flexible cords and lines. This arrangement again suffers from the drawback that it is not capable of providing imaginative flight patterns because the airplane simply flies in a circle around the stand at an essentially constant height as determined by the speed of the airplane and the attitude of the plane's elevators which are only adjustable prior to flight. Furthermore, because the airplane is not capable of maintaining flight above the supporting stand, its maneuverability is considerably limited.

Recently there has been a very keen interest in unidentified flying objects and more particularly, flying spaceships, and to the knowledge of the present inventor, no one has yet developed an electrically powered flying toy usable both within and outside of the home which is capable of three dimensional flight patterns at a multitude of different altitudes.

According to the present invention, a flying toy is provided which is highly maneuverable and capable of three dimensional flight patterns without requiring extensive skills on the part of the operator. Furthermore, it is extremely well balanced in order to avoid crashing during a flight pattern. The toy comprises a flying body and a flexible cable interconnecting the flying body and means for operating the flying body which may be in the form of either a hand-held control or a fixed rotating stand. The flying body which is capable of essentially free flight, is provided with four identical propellers rotatable in the horizontal plane for providing lift to the structure. These propellers are arranged in a rectangular pattern about a centrally located drive motor, which drives gear means for rotating the four identical propellers at the same speed, thereby ensuring the stability of the body at the end of the flexible cable. A fifth smaller propeller, which is also rotatable by the motor, is included to provide forward movement to the flying body. However, the effect of the smaller propeller is relatively insignificant compared to the effect of the larger propeller because the flying body is not dependent upon its forward speed for maintaining stability at the end of the flexible cable.

BRIEF DESCRIPTION OF THE DRAWINGS

Other features of the present invention will become evident from the following detailed description according to the preferred embodiments wherein.

DETAILED DESCRIPTION OF THE PREFERRED EMBODIMENTS OF THE INVENTION

Figure 1:
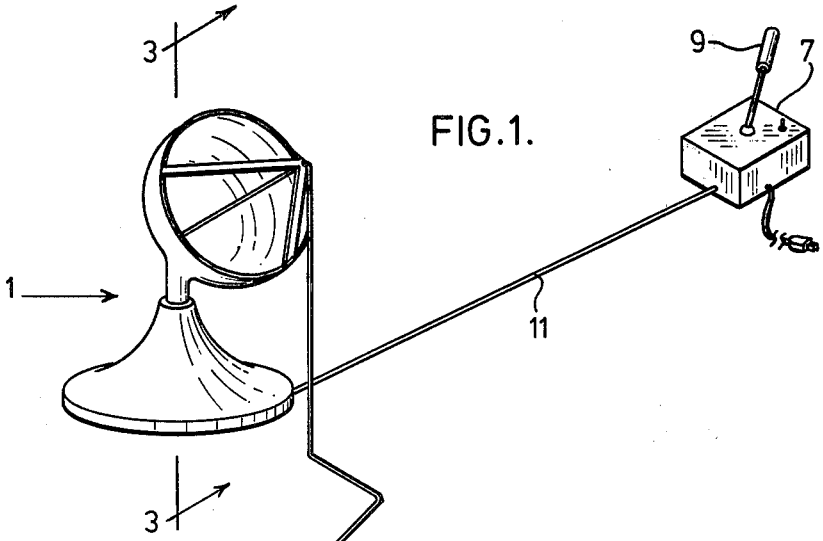
FIG. 1 is a perspective view looking down on a preferred arrangement of a toy according to the present invention, with the flying body in a landed position.
Figure 2:
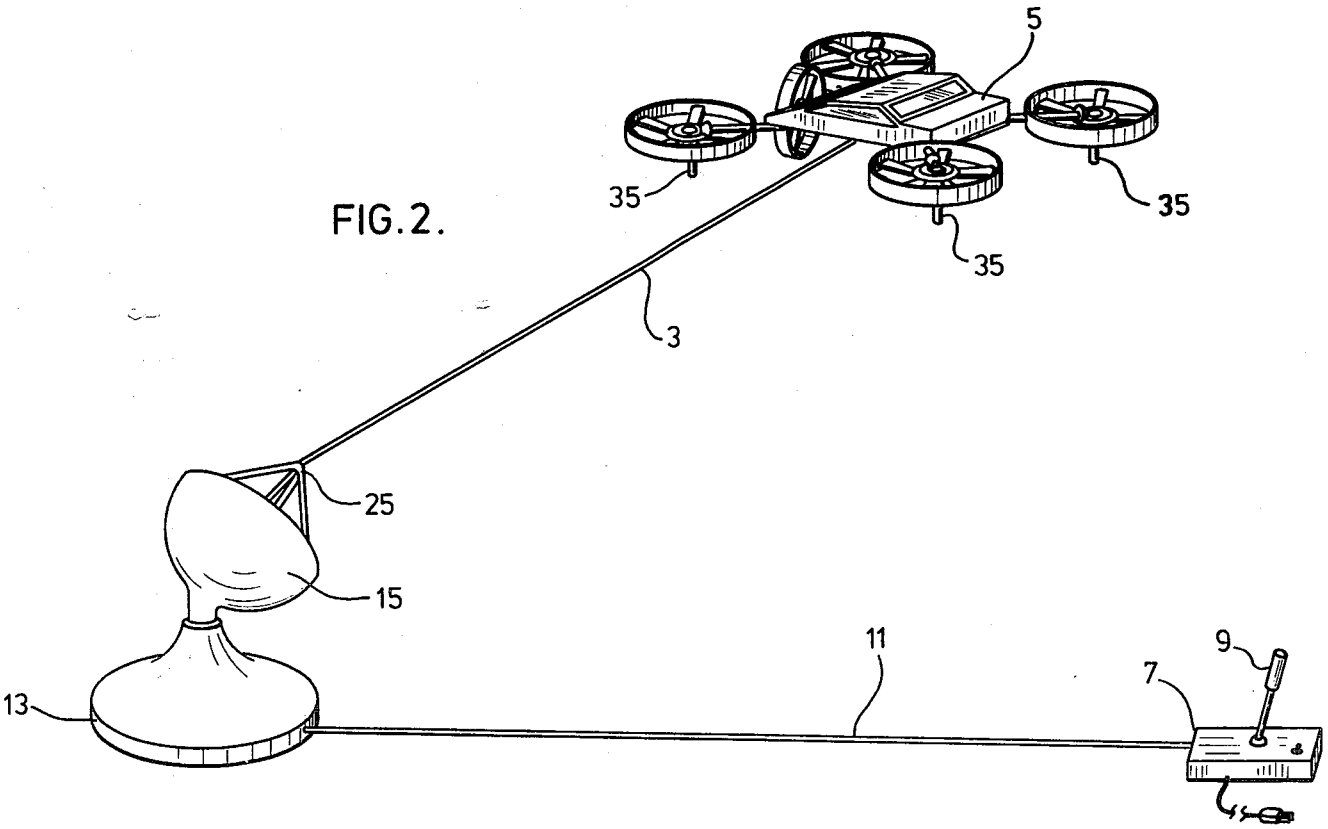
FIG. 2, on the second page of drawings is a view similar to FIG. 1 showing the flying body in flight.
Figure 6:
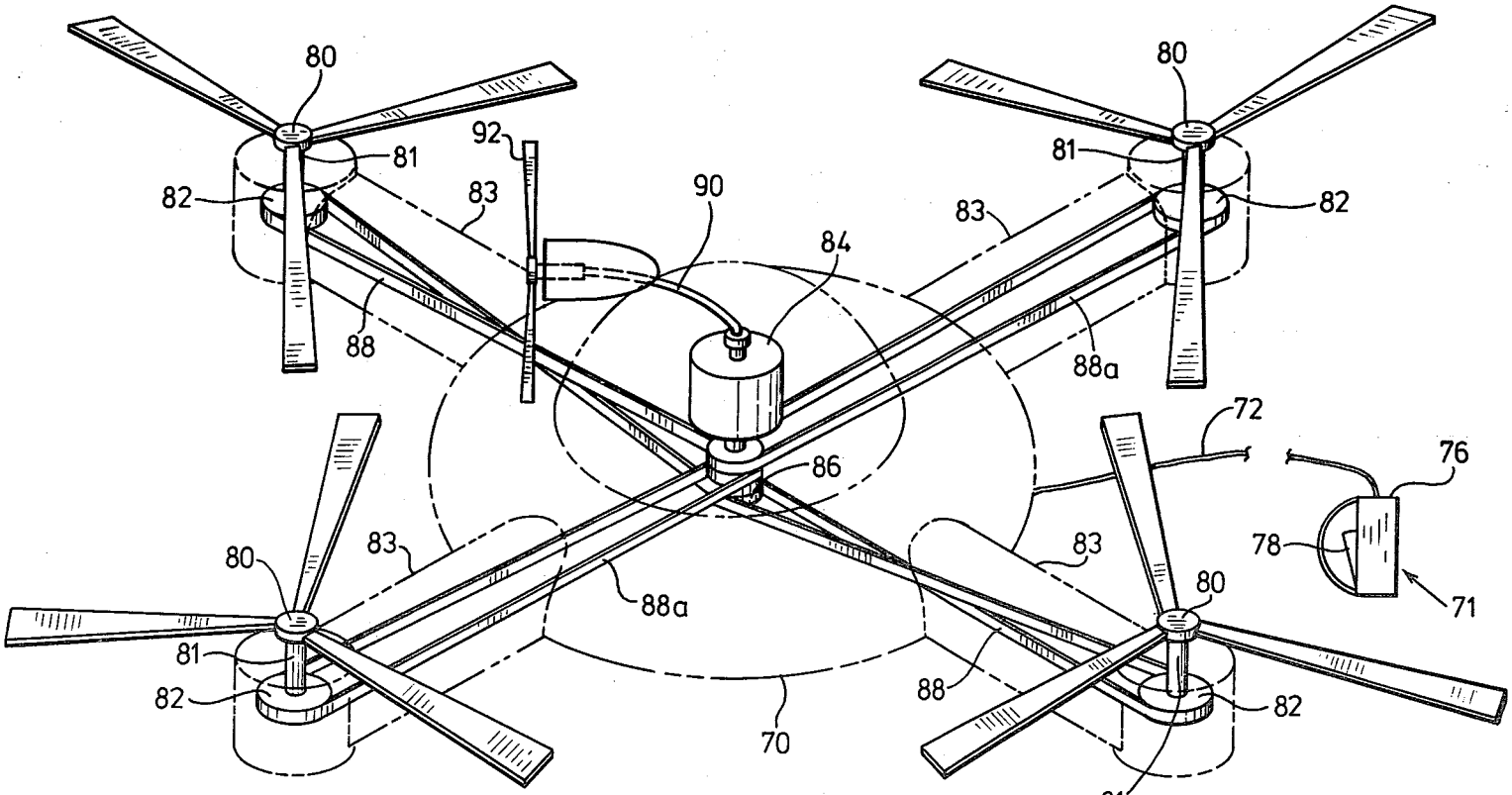
FIG. 6 is a perspective view looking down on a preferred arrangement of a spaceship according to the invention.

FIGS. 1 and 2 show the toy arrangement when provided with a rotatable stand or base, however this is only one aspect of the invention and the flying spaceship body may also be controlled by a battery operated hand-held control as shown in FIG. 6.

Figure 3:
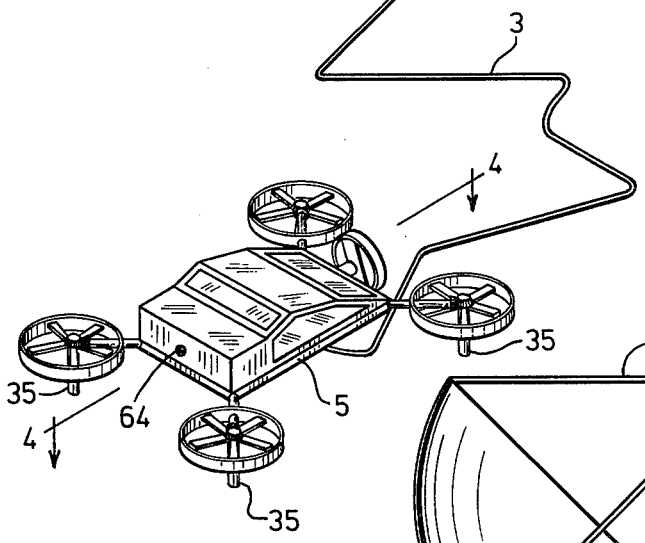
FIG. 3 is an enlarged sectional view of the stand taken along the lines 3—3 of FIG. 1.
Figure 3:
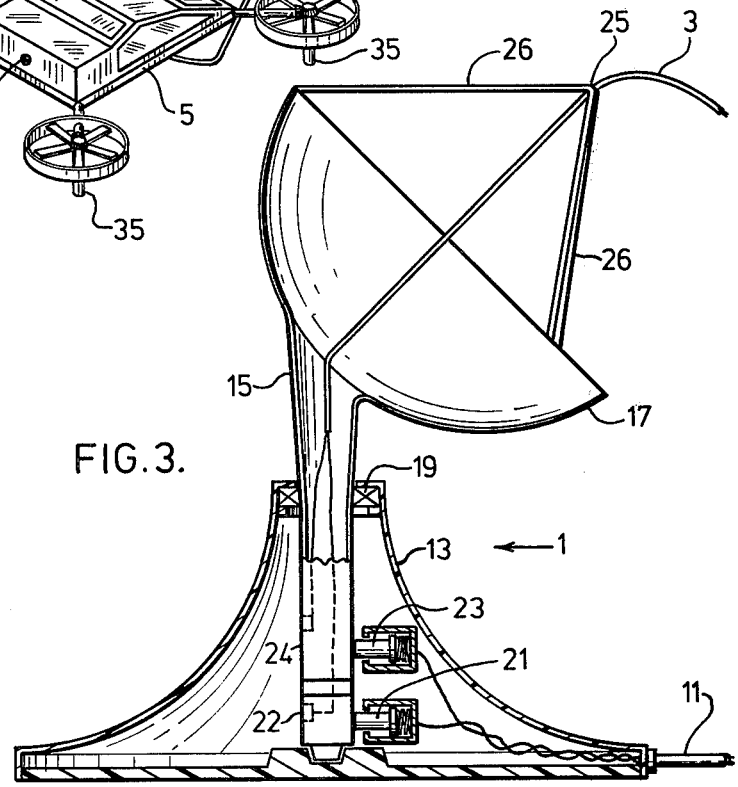

Referring to what is shown in FIGS. 1 to 3, the toy spaceship arrangement includes a stand generally indicated at 1, a spaceship body 5 connected to the stand by flexible cable 3, and operating means for providing electric current to the stand and spaceship body in the form of AC to DC convertor 7. The convertor is plugged into any conventional wall socket and includes an adjustable control arm 9 for varying the current provided to the stand and spaceship body. AC to DC convertor 7 is connected to the stand by means of power cable 11. Referring to FIG. 3, stand 1 includes a base portion 13 and a rotatable portion 15 rotatably engaged in the base portion by means of ring bearing 19. The rotatable portion includes a radar-shaped unit open mouth 17 with cable 3 supported centrally of the mouth by means of tripod arrangement 25, including three supporting legs 26 fixed to the periphery of the mouth. The rotatable portion of the unit is supported at its base as shown in FIG. 3 with the electrical connections being made by brushes 21 and 23 which maintain contact with electrical post portions 22 and 24 respectively of the rotatable portion of the unit. As can be seen from the Figure, electrical power cable 11 feeds electricity to cable 3 through this electrical connection.

Figure 4:
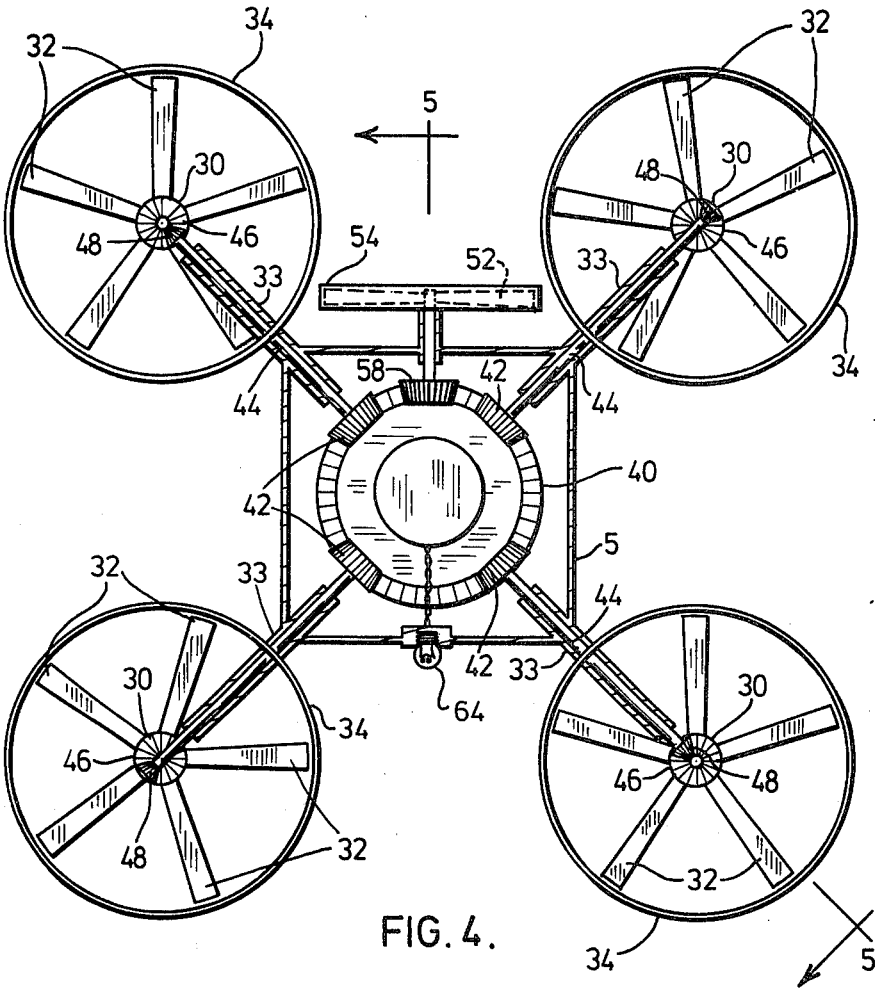
FIG. 4 is an enlarged section view of the flying body taken along the lines 4—4 of FIG. 1.
Figure 5:
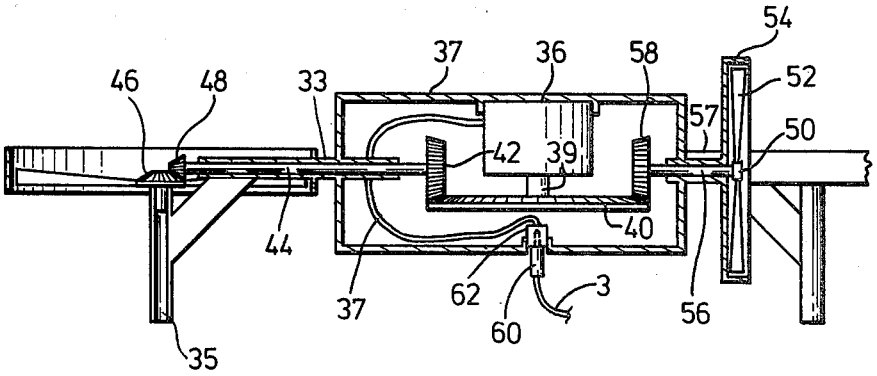
FIG. 5 is a sectional view taken along the lines 5—5 of FIG. 4.

Referring to FIGS. 4 and 5, spaceship body 5 is provided with propellers 30 which rotate in the horizontal plane. These propellers are arranged in a rectangular, and more particularly, a square pattern with drive motor 36 located centrally of the propellers in a balanced position.

As is best shown in FIG. 5, cable 3 is jacked to the electrical cable 37 of motor 36 by means of the male/-female connection consisting of female socket 62 adapted to receive male connector 60, which is readily removeable from the female socket.

Main bevel gear 40 is connected to drive shaft 39 of electrical motor 36 and engages a plurality of smaller bevel gears 42 for driving the horizontally rotating propellers 30. It will be noted that smaller bevel gears 42 are equal in size and therefore, rotated at the same speed by bevel gear 40.

Bevel gears 42 are fixed at the end of drive shafts 44, which interconnect the small bevel gears with the propellers. Drive shaft bevel gears 48 at the outer end of the drive shafts, gearingly engage the propeller bevel gears 46 for rotation of the propellers.

According to the arrangement shown in FIGS. 4 and 5, all the horizontal propellers rotate in the same direction which tends to rotate the entire spaceship body thereby providing a further highly intriguing flight maneuver. The jack connection has been specifically provided to permit rotation of the body without cutting off the electrical current to the motor 36.

Referring again to FIGS. 4 and 5, the spaceship body is also provided with a vertically rotating propeller 50, which is connected by means of drive shaft 56 and bevel gear 50 to the main bevel gear 40, so that the vertically rotating propeller is also driven by electrical motor 36. The four relatively large horizontally rotating propeller blades provide upward movement or lift for the spaceship body while the single smaller vertically rotating propeller provides forward movement for the spaceship body.

The spaceship body is additionally provided with a frame arrangement for enclosing and protecting the moving parts of the structure. The frame structure includes main enclosure 37 housing the electrical motor and inner bevel gears, a plurality of drive shaft casings 33 completely enclosing the drive shafts 44 and a plurality of ring shaped propeller casings 34 surrounding the propeller blades 32 of propellers 30. Also included are drive shaft casing 57 enclosing drive shaft 56 of the vertically rotating propeller and protective frame 54 surrounding the blades 52 of the vertically rotating propeller. Extending downwardly and forming a part of the frame are a plurality of landing legs 35, which can be best seen in FIG. 2 for supporting the spaceship body when in a landing position.

Protective propeller casings 34 and 54 fulfill a plurality of functions. Firstly, the toy is primarily for use by a child and they provide protection against the insertion of a finger directly in the path of the outer edges of the propeller blades. Secondly, because the propeller blades will generally be made of a hard plastics material, rather than a flexible material, which would tend to deform at high rotation speeds and not provide adequate lift for the structure, the casings protect the blades from breaking by blocking them from contact with objects such as the wall of a room, or a table leg.

An additional and very important function of the protective propeller casings is to prevent entanglement between the propeller blades and the flexible cable interconnecting the spaceship body with the stand. As can best be appreciated from FIG. 1, this would normally present a substantial difficultly due to the fact that the flexible cable can easily coil beneath and around the spaceship body, however, as discussed above, it is the flex in the cable which is essential in providing multidimensional flight patterns and the provision of the protective casings overcomes the difficulty presented by the flex and coil of the cable when it is not pulled taut during flight.

The uniqueness and advantages of the present invention become readily apparent from FIGS. 1 and 2 of the drawings. The spaceship body rests on its supporting legs 35 when in the landed position. In order to fly the spaceship body, controlling lever 9 of convertor box 7 is manually adjusted to supply electrical current to motor 36 through the stand by means of flexible cable 3. By moving lever 9 forward slightly, both the horizontally orientated propellers, as well as the vertically orientated propeller begin to rotate. However, because the horizontal propellers outnumber and are much larger than the vertical propeller, the main direction of movement of the spaceship body is upward with only a minor amount of forward movement. The height at which the spaceship body is flown is determined by the amount of adjustment of control lever 9 and if desired, the spaceship body may be flown at a very low altitude or at a maximum height well above the stand as shown in FIG. 2.

The spaceship body is in no way supported by cable 3 and is essentially a free body during its climb to the maximum altitude, which is clearly in contrast to the prior art devices. However, the spaceship body is completely balanced through the provision of the propeller arrangement with the centrally located motor, such that it does not tip and dive when in flight. The spaceship body moves away from the stand until cable 3 becomes taut to provide a reactive force tending to pull the spaceship body back in towards the stand. It is at this point that the stand is influenced by the spaceship body. Since cable 3 is supported centrally of the rotatable portion of the stand, it rotates under the pull of the spaceship body and tracks the flight of the spaceship body, thereby simulating a spacetracking operation, which maintains the interest and intrigue of the child operating the toy.

In order to simulate night tracking conditions, light 64 is provided for illuminating the spaceship body. In addition, stand 1 may also be provided with a light which is focused on the spaceship body by the mouth shape of the rotatable portion when the spaceship body is at full altitude. The operator may then control the spaceship body to fly in and out of the light beam projected upwardly and outwardly from the stand by simply reducing and increasing the rotation of the propellers.

FIG. 6 shows a unique arrangement in which the flying spaceship body 70 is manually controlled by a hand-held operating means generally indicated at 71. Again one of the primary features of this arrangement is its ability to perform essentially unrestricted flight maneuvers, while at the same time, being a highly stable spaceship body which does not require expertise on the part of the user for its operation.

Hand-held operating means 71 comprises battery casing 76 and a manually adjustable trigger mechanism 78 for controlling the amount of electrical current passing through flexible cable 72 to electrical motor 84 of the spaceship body.

Spaceship body 70 is provided with four outwardly extending arms 83, which support the horizontally rotating propellers 80. Provided at the base of each propeller shaft 81 is a grooved disc member 82, which in combination with central gearing arrangement 86 rotated by motor 84, drive the propellers 80. Gearing arrangement 86 consists of four adjacent grooved disc members essentially identical to members 82. The upper two grooved members of gearing arrangement 86 are connected to their respective disc-like members 82 by means of elastic bands 88*a*, while the lower two disc members of gear arrangement 86 are connected to their respective grooved disc members 82 by means of twisted elastic bands 88. It will be noted that bands 88*a* extend between diametrically opposing propellers with the same being true for bands 88.

Vertically rotating propeller 92 is connected to motor 84 by means of coil spring 90, which is controlled by the motor to rotate propeller 92.

Propellers 80 are driven by means of the frictional engagement of the rubber bands with the grooved discs at the base of the propeller shafts and the grooved discs of the central gearing arrangement. Furthermore, because rubber bands 88*a* are twisted while rubber bands 88 are not, the propellers driven by the twisted rubber bands rotate in the opposite direction to those driven by the non-twisted bands, such that diametrically opposing propellers rotate in the same direction with adjacent propellers rotating in opposite directions. This reversal of direction of adjacent propeller blades prevenst the rotation of the entire spaceship body during flight. As will be appreciated, the two different sets of propeller blades are canted in opposite directions so that upon rotation they both lift the structure.

The length of cable 72 may be adjustable as determined by operating conditions. For indoors use, the cable is adjusted to shorter lengths and lengthened for outdoor use.

Although various preferred embodiments of the invention have been described herein in detail, it will be appreciated by one skilled in the art that variations may be made thereto without departing from the spirit of the invention or the scope of the appended claims.

What I claim is:

1. An electrically powered toy including a stand having a rotatable portion, a flying body adapted to fly above said stand, and a flexible cable interconnecting the flying body and rotatable portion of the stand, the flying body being provided with four identical propellers rotatable in the horizontal plane and arranged in a rectangular pattern, a drive motor located centrally of the four propellers, gear means driven by the motor for rotating said four identical propellers at the same speed, and a fifth smaller propeller rotatable by the motor in the vertical plane.

2. A toy as defined in claim 1, including a protective frame around each propeller.

3. A toy as defined in claim 1, wherein said rotatable portion of the stand consists of a radar-shaped member rotatably secured in said stand and said flexible cable is supported centrally of said radar shaped member which tracks the flying body during flight.

4. A toy as defined in claim 1, including a light for illuminating the flying body.

5. A toy as defined in claim 2, including a landing leg extending downwardly from the protective frame around each of the four identical propellers.

6. A toy as defined in claim 1, wherein adjacent propellers of the four identical propellers rotate in opposite directions and diametrically opposing propellers of the four identical propellers rotate in the same direction.

7. A toy as defined in claim 1, wherein the four identical propellers are arranged in a square pattern.

8. A toy as defined in claim 6, wherein said propellers are driven by rubber bands two of which are twisted and two of which are untwisted, the two untwisted rubber bands driving diametrically opposing propellers, the twisted rubber bands driving the propellers adjacent those driven by the untwisted bands.

9. An electrically powered toy comprising a flying body, means for operating the flying body and a flexible cable interconnecting the flying body and means for operating the flying body, the flying body being provided with four identical propellers rotatable in the horizontal plane and arranged in a rectangular pattern, a drive motor located centrally of the four propellers, gear means driven by the motor for rotating said four identical propellers at the same speed, and a fifth smaller propeller rotatable by the motor in the vertical plane.

10. A toy as defined in claim 9, wherein said means for operating the flying body comprises a hand-held control.

* * * * *